United States Patent [19]

Guanzini

[11] 3,974,535

[45] Aug. 17, 1976

[54] BOAT HULL WITH SPHERICAL DOME

[75] Inventor: Aldo Guanzini, Boulens, Switzerland

[73] Assignee: Nauterra S.A., Lausanne, Switzerland

[22] Filed: Dec. 17, 1974

[21] Appl. No.: 533,634

[30] Foreign Application Priority Data

Dec. 18, 1973 Switzerland ..... 17710/73

[52] U.S. Cl. ..... 9/1.3; 114/39; 114/61; 114/123; 115/70

[51] Int. Cl.[2] ..... B63B 1/06; B63B 39/06

[58] Field of Search ..... 9/1 A; 114/126, 123, 114/56, 61, 66.5 R, 39; 115/70

[56] References Cited

UNITED STATES PATENTS

| | | | |
|---|---|---|---|
| 2,781,735 | 2/1957 | Roberts et al. | 114/66.5 RM |
| 2,826,163 | 3/1958 | King | 9/1 A |
| 2,849,978 | 9/1958 | Durham | 114/16 R |
| 2,995,104 | 8/1961 | Mills | 114/56 |
| 3,094,962 | 6/1963 | Goar | 114/66.5 R |
| 3,225,367 | 12/1965 | Gavlek | 9/1 A |
| 3,279,417 | 10/1966 | Moore et al. | 115/70 |
| 3,452,698 | 7/1969 | Wilson | 114/66.5 R |

*Primary Examiner*—Trygve M. Blix
*Assistant Examiner*—Gregory W. O'Connor
*Attorney, Agent, or Firm*—Tab T. Thein

[57] ABSTRACT

A boat comprising a hull the general shape of which is a spherical dome which in the fore part of the boat extends to above the water-line at maximum load while at the sides the part of the hull above the water-line departs from a spherical shape and progressively approaches a cylindrical shape, and further comrising at least one float-forming lee-board disposed at the aft and rigidly connected to the hull, and a single propeller orientable about a vertical axis comprised in the median longitudinal plane of the boat.

6 Claims, 5 Drawing Figures

16
15
1

17
15
11
25
23
3
20
21
22
19
27
28
1
29

BOAT HULL WITH SPHERICAL DOME

Boats of generally circular shape have already been proposed. Certain of these have a hull at least the submerged part of which is in the shape of a spherical dome. Others have a more or less cylindrical hull and a dished or slightly dished non-spherical bottom. Boats in the first category have desirable hydrodynamic qualities but have the drawback of tending to incline excessively during sailing when the center of gravity temporarily or in a protracted manner adopts an asymmetric position relative to the hull, under the action of propelling means or simply as a result of waves.

The present invention aims to provide a boat of the above-indicated type but which is exempt of their drawbacks. The boat according to the invention is characterized in that it comprises a hull the general shape of which is a spherical dome which in the fore part of the boat extends to above the water-line at maximum load while at the sides the part of the hull above said water-line departs from a spherical shape and progressively approaches a cylindrical shape, and in that it comprises at least one float-forming lee-board disposed at the aft and rigidly connected to the hull, and a single propeller orientable about a vertical axis comprised in the median longitudinal plane of the boat.

The accompanying drawings show, by way of example, an embodiment of the boat according to the invention.

Figure 4:
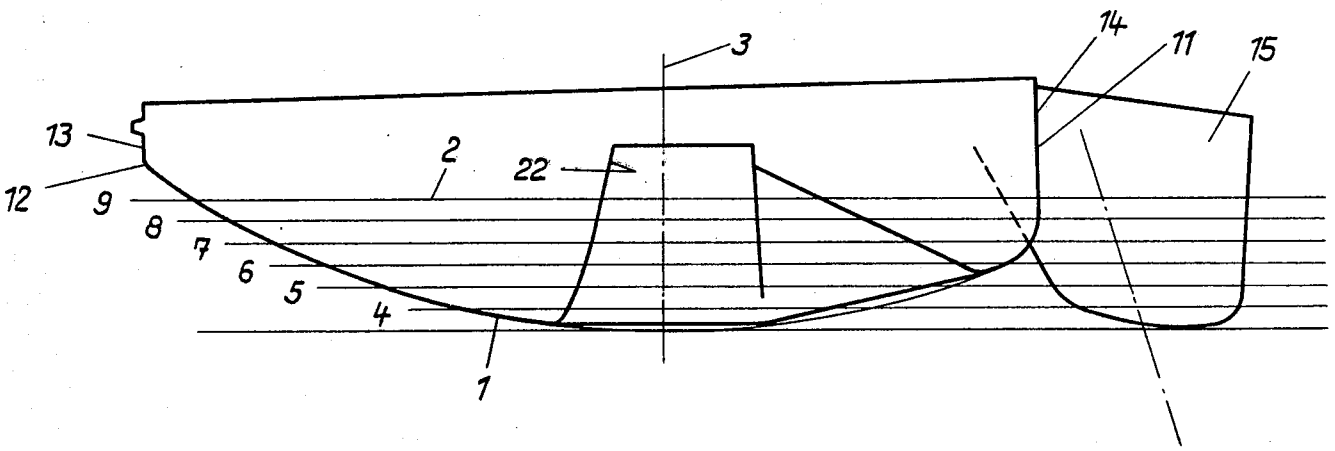
FIG. 4 is a schematic side view serving to illustrate the shape of the hull.
Figure 5:
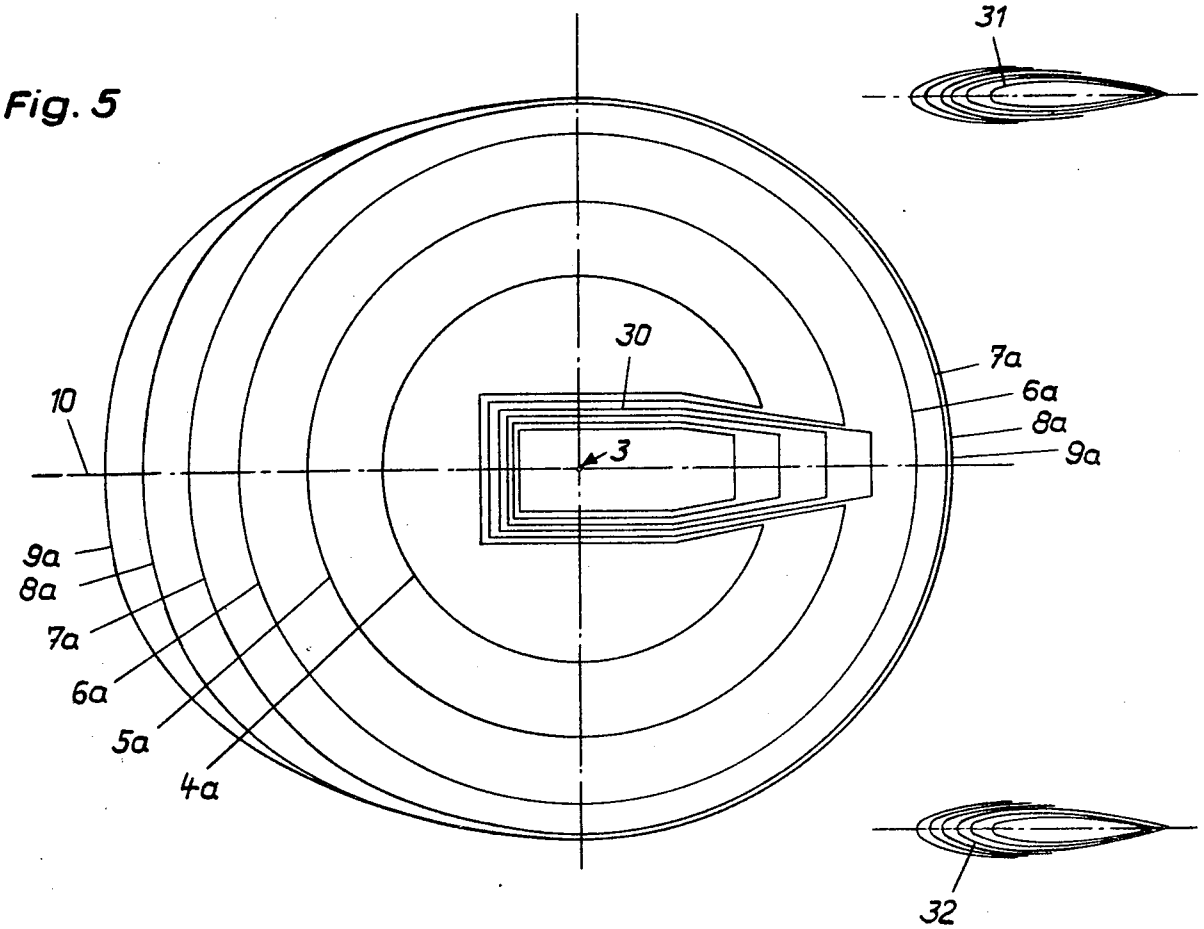
FIG. 5 is a schematic plan view corresponding to FIG. 4 and showing the shape of successive horizontal cross-sectional lines of the hull.

The boat shown comprises a hull 1 having a shape which will be seen from the explanations given with reference to FIGS. 4 and 5.

On FIG. 4 the water-line of the boat under maximum load is shown at 2, and 3 is a vertical axis about which is centered a spherical dome whose shape coincides with that of the lower part of the hull below the water-line. 4, 5, 6, 7, 8 and 9 are successive horizontal cross-sectional lines of the hull 1 and FIG. 5 shows, in plan view of the hull, the corresponding shape of these various cross-sectional lines.

It is seen that at 4*a* the cross-section of the hull 1 is circular since that part of the hull is spherical. At 5*a* and 6*a* it is also circular. However, at 7*a*, in the left-hand part of FIG. 5, the major part of the hull is a circular arc of the spherical dome, whereas at the right-hand part it is a concentric circle of smaller radius. This is easily understood by considering the right-hand part of FIG. 4.

At 8*a*, on the left-hand part of FIG. 5, the circular part concentric to axis 3 and symmetrical about the longitudinal median plane 10 of the boat extends over only a small angle. At 9*a*, on the left-hand part of FIG. 5, it is seen that the fore end of the boat still forms part of the sphere. It is observed that in the right-hand part of FIG. 5 the various curves 6*a*, 7*a*, 8*a* and 9*a* are also circles centered about axis 3, but of smaller radius. Moreover, in this right-hand part of FIG. 5, curves 8*a* and 9*a* coincide, which is easily understood by considering FIG. 4, since the rear of the boat is cylindrical.

It was stated above that the left-hand part of FIG. 4 represents the fore of the boat. This fore part has a shape which can be defined as follows. At the fore end, in median plane 10 (FIG. 5), the hull is spherical, i.e. the profile of the hull 1 shown in FIG. 4 is an arc of a circle up to a point 12 situated above the water-line 2 at maximum load. The part 13 above point 12 is cylindrical in this example. On FIG. 4, this part 13 is thus vertical.

Figure 3:
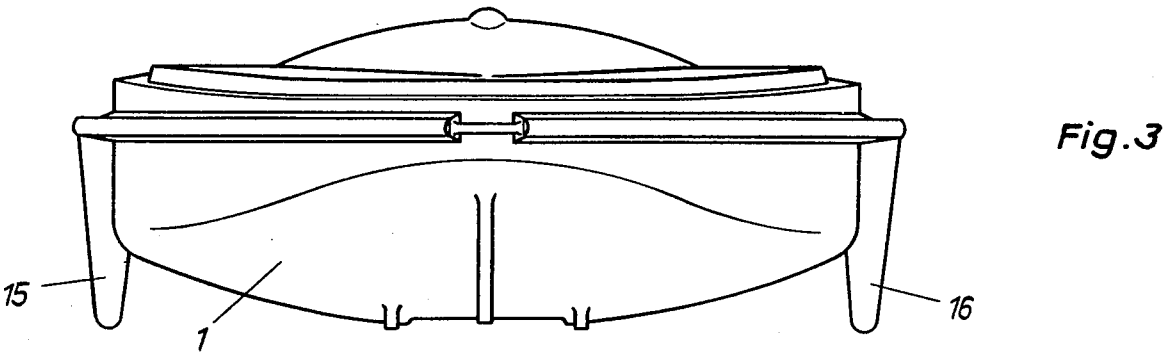
FIG. 3 is a front elevation.

At the aft, the part of the hull 1 situated above section line 6 departs from the spherical shape, such as at a level 11, and progressively approaches the cylindrical shape shown at 14. On the sides of the boat, the shape of the hull is that of a surface which progressively joins the fore and aft shapes. The front elevation according to FIG. 3 enables this shape to be appreciated.

Apart from the hull 1, the boat comprises two lee-boards/floats 15, 16 situated at the aft of the boat, spaced apart from the hull, and each connected thereto by a rigid piece 17, 18 respectively. These lee-boards/-floats are naturally disposed symmetrically in relation to the longitudinal median plane 10.

The boat also comprises a propeller means 19 orientable at will by 360° about an axis parallel to vertical axis 3. In a variation, these two axes could coincide. This propeller means is formed, in the example shown, by an internal combustion engine 20 driving a propeller 21.

Figure 1:
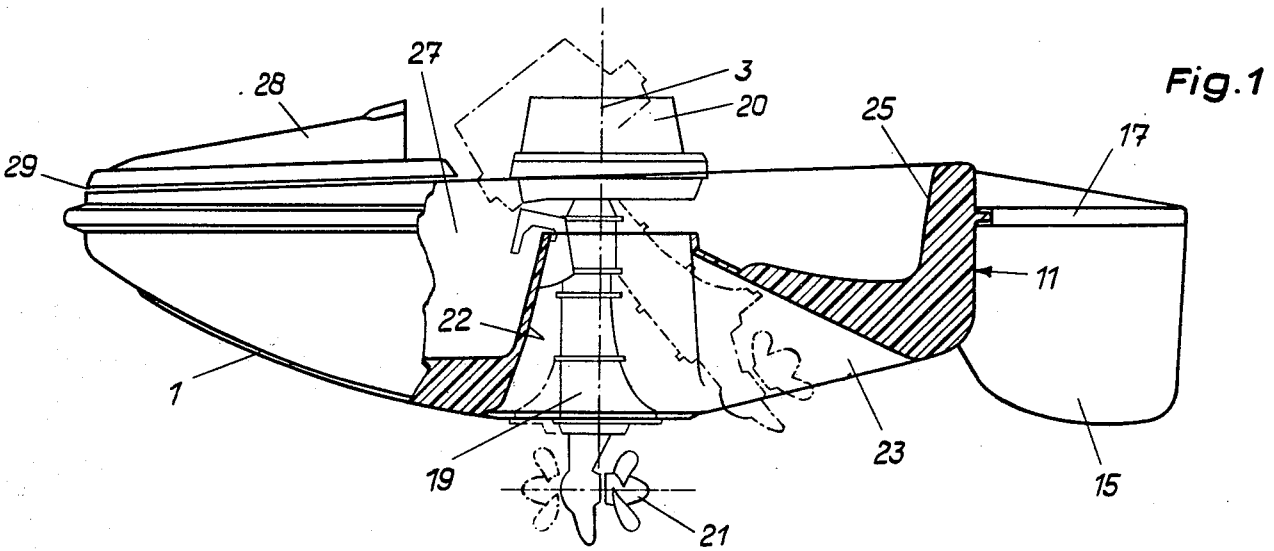
FIG. 1 is a longitudinal vertical cross-section.

The lower part of propeller means 19 is disposed in a recess 22 of the hull. Towards the aft, the recess 22 is extended by a channel 23 in which the propeller means can be folded, as shown in dot-dash lines in FIG. 1, when it is desired to raise the propeller 21.

Figure 2:
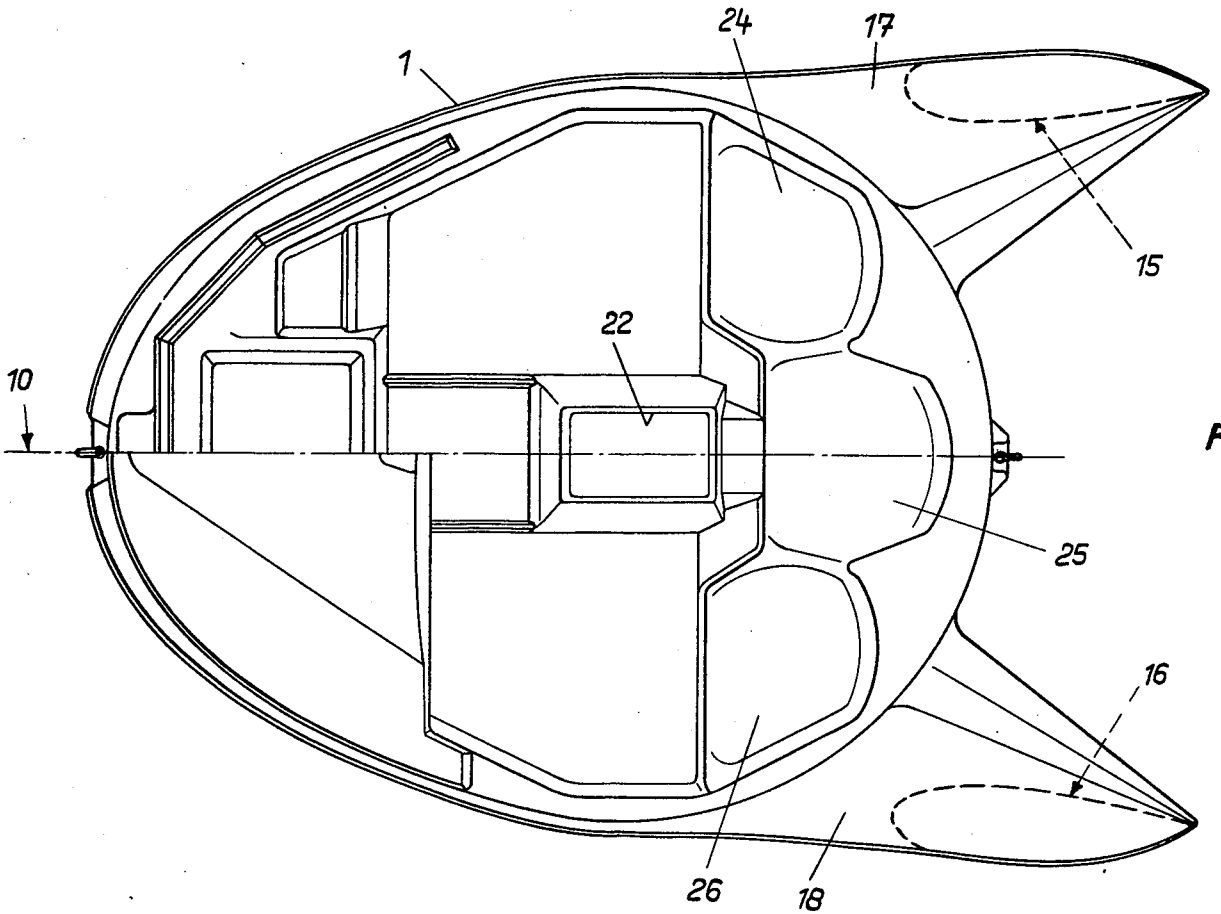
FIG. 2 is a top plan view.

On FIG. 2, the propeller means is not shown but the recess is visible at 22. At 24, 25 and 26 are shown passenger seats. At the fore there is an empty space 27 serving for storage and covered partially by a cover 28 which may be hinged at 29.

Referring to FIG. 5, 30 designates the various horizontal section lines of recess 22, and 31, 32 the various horizontal section lines of the lee-boards/floats 15, 16, in the planes 4, 5, 6, 7, 8 and 9. It can be readily understood that in view of the presence and disposition of the lee-boards/floats the described boat has a better trim than a boat of the same shape but without these members, which is an incontestable advantage.

It is also possible to have three lee-boards (not shown), two of them being disposed as 15 and 16 and the third in the median plane 10.

It will be observed that in the case of a single lee-board which would be disposed in the longitudinal plane of the boat, stable reversing would not be possible.

Finally, in another embodiment, the boat could additionally be provided with a mast (not shown) for sailing, and a lee-board disposed below the mast and orientable to form a rudder.

The description has concerned the case where the lee-boards/floats are disposed spaced-apart from the hull and connected thereto by rigid joining pieces. Of course, these lee-boards/floats could also be directly fixed to the hull or made integral therewith (not shown) in the case of a molded hull. In this case, they would advantageously be arranged so that at least their major part is located outside the plane of the hull.

The described boat, as well as its possible variations, has the following handling advantages and characteristics:

a. good ratio between displacement and useful interior volume. For example for a boat weighing 50 kg unloaded and carrying a load of 400 kg, there is a displacement of 450 kg with a surface area to the water-line of 2.6 $m^2$ and a draft of 0.3 m. Such a boat can have a useful bearing surface of 4.5 $m^2$ capable of being arranged to transport the previewed load;

b. a good power/performance ratio: this type of hull may be considered as intermediate between displacement hulls and planing hulls; in effect, even at low speeds the sum of the vertical resultants of the dynamic pressures exerted at different places on the principal hull gives a single resultant directed vertically upwards. The value of this resultant depends on the inherent lifting power of the hull for translational movement, and reduces the displacement to balance the weight of the boat. There is thus a greater ability to sew compared to a traditional displacement hull; the lower part of the lee-boards/floats can also be designed to produce an additional lift for translational movement.

Moreover, the submerged profiles both of the hull and of the lee-boards/floats enable a good flow of the displaced water and offer a low resistance to advancement.

These characteristics enable a saving of fuel by the use of low-power motors: for example, a boat measuring 2.5 × 1.8 m weighing 50 kg and carrying a load of 300 kg can reach a speed of 6 km/h with a power of only 0.25 HP;

c. good manoeuvrability: this formula enables, due to the combined effects of the position of the propeller means and the characteristic reactions of the lee-boards/floats, an absolute manoeuvrability to be obtained. The boat can perform the following movements: stable forward motion — stable reverse motion — turning with any radii for both forward and reverse motion — controlled autogyration (radius of turning equal to zero);

d. non-capsizable: the conception of this formula makes it practically impossible, whatever be the position of the center of gravity and the external factors, to obtain a position of the longitudinal or lateral metacenters outside the vertical extension of the center of pressure; the boat can thus be considered non-capsizable. Even in the event of a breakdown of the propeller means or for any other cause placing the boat out of control, its orientation relative to the swell is immaterial and involves no risk;

e. favorable weight-solidity ratio because of the generally quasi-circular shape enabling high safety coefficients to be obtained and a reduction of the cost price of manufacture.

What I claim is:

1. A boat comprising a hull the general shape of which is a spherical dome which in the fore part of the boat extends to above the water-line at maximum load while at the sides the part of said hull above the water-line departs from a spherical shape and progressively approaches a cylindrical shape; at least one float-forming lee-board disposed at the aft of the boat and rigidly connected to said hull, said lee-board constituting means for increasing stability of the boat against rolling and pitching, and for dynamically defining a median longitudinal plane of the boat; and a single propeller orientable about a vertical axis comprised in the median longitudinal plane, said propeller constituting means for compelling the boat to turn on itself, when the orientation of said propeller is altered, and for maintaining the median longitudinal plane in the direction of the displacement of the boat, due to the reaction produced by said lee-board.

2. The boat as defined in claim 1, wherein said at least one lee-board is spaced apart from said hull; further comprising at least one element situated at least partly above the water-line for connecting said at least one lee-board to said hull.

3. The boat as defined in claim 1, wherein said at least one lee-board is directly attached to said hull, but with at least its major part being out of the plane of said hull.

4. The boat as defined in claim 1, which comprises two of said lee-boards spaced symmetrically apart from the median longitudinal plane of the boat.

5. The boat as defined in claim 4, wherein said hull with said rigidly connected two lee-boards defines at the maximum load a closed peripheral outline at the water-line, which outline has a substantially curved peripheral portion about said fore part of the boat, corresponding to about half of the sphere of the dome and being composed of a circular arc of the latter, successively two substantially rectilinear peripheral side portions from a median transversal plane of the boat along said sides of the hull to the tips of said two lee-boards, and finally a straight outline portion that interconnects said tips at said aft of the boat.

6. The boat as defined in claim 1, wherein the axis about which said single propeller is orientable substantially coincides with a vertical line passing through the center of the sphere of the dome.

* * * * *